United States Patent [19]

Lyshkow et al.

[11] 4,144,019

[45] Mar. 13, 1979

[54] VORTEX TYPE BURNER

[75] Inventors: Norman A. Lyshkow, Brooklyn, N.Y.; Herbert E. Beningson, Stamford, Conn.; Camillo V. Di Ruocco, Ossining, N.Y.

[73] Assignee: Combustion Equipment Associates, Inc., New York, N.Y.

[21] Appl. No.: 780,940

[22] Filed: Mar. 24, 1977

[51] Int. Cl.[2] ..... F23C 5/08

[52] U.S. Cl. ..... 431/173; 110/264

[58] Field of Search ..... 431/173; 110/28 F, 266

[56] References Cited

U.S. PATENT DOCUMENTS

| | | | |
|---|---|---|---|
| 2,707,444 | 5/1955 | Van Loon | 110/28 F |
| 2,827,022 | 3/1958 | Krause | 110/28 F |
| 3,025,844 | 3/1962 | Geissler | 110/28 F |
| 3,039,406 | 6/1962 | Aref | 110/28 F |

FOREIGN PATENT DOCUMENTS

| | | | |
|---|---|---|---|
| 1014268 | 8/1957 | Fed. Rep. of Germany | 110/266 |

*Primary Examiner*—Alan Cohan

*Attorney, Agent, or Firm*—Blum, Moscovitz, Friedman & Kaplan

[57] ABSTRACT

A burner of the double vortex type wherein combustibles travel in an outer spiral during which time the combustibles ignite and burn and the combustion products are expelled from the burner by travelling along an inner spiral. The inner and outer spiral layers are separated by a cylindrical wall to prevent disruption of the currents and countercurrents and adverse turbulence as a result thereof in order that the combustibles and particularly solid fuels are entrained in the combustion stream for a sufficient residence time for maximum combustion and minimum particulate emission. The burner is particularly suitable for operation at slagging temperatures so that the slag can be collected and drawn off to further reduce particulate emission.

17 Claims, 2 Drawing Figures

VORTEX TYPE BURNER

BACKGROUND OF THE INVENTION

This invention is concerned with an improvement in a burner sometimes called a double vortex burner of the types generally shown in U.S. Pat. Nos. 2,736,168; 3,200,870 and 3,352,345. The double vortex burners disclosed in the aforesaid patents were believed to provide a flow of combustibles whereby the particulate matter would be entrained for a sufficient period to permit substantially complete combustion thereby rendering such burners suitable for the combustion of solid matter which was otherwise considered difficult to burn.

However, the burners of the prior art did not live up to their expectations and it was found in some instances that unburned particulate was delivered with the exiting gases and that, in some cases, the particulate collected on the walls of the burner thereby reducing complete combustion and requiring shut-down for cleaning of the burner.

SUMMARY OF THE INVENTION

Generally speaking, in accordance with the invention a burner of the double vortex type has an inlet through which air is introduced for spiral travel at predetermined velocity and fuel is introduced therein to be entrained in the air and to be carried there along for combustion. The burner has an end which reverses the flow of the combustion gases and the particulate to thereby cause the combustion gases and particulate to travel outwardly within the spiral path of the gases travelling in the initial direction. A cylindrical wall which is spaced from the reversing end of the burner is positioned between the gases flowing toward the end wall and the gases flowing from the end wall. With proper design, the fuel has a sufficient residence time to be completely or substantially completely burned and the burner is preferably operated at temperatures which are sufficiently high to cause slagging of the non-combustibles so that relatively clean air is delivered from the burner and the slag is tapped off as a liquid.

Accordingly, it is an object of this invention to provide a burner of an improved construction.

Another object of the invention is to provide an improved construction in a burner of the double vortex type.

A further object of this invention is to provide an improved burner wherein combustion gases flowing in opposite axial direction will be separated to prevent interfacial turbulence.

Still another object of this invention is to provide an improved burner in which particulate to be burned is entrained in gases flowing through the combustion zone for a sufficient residence time to permit substantially full combustion.

Still other objects and advantages of the invention will in part be obvious and will in part be apparent from the specification.

The invention accordingly comprises the features of construction, combinations of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
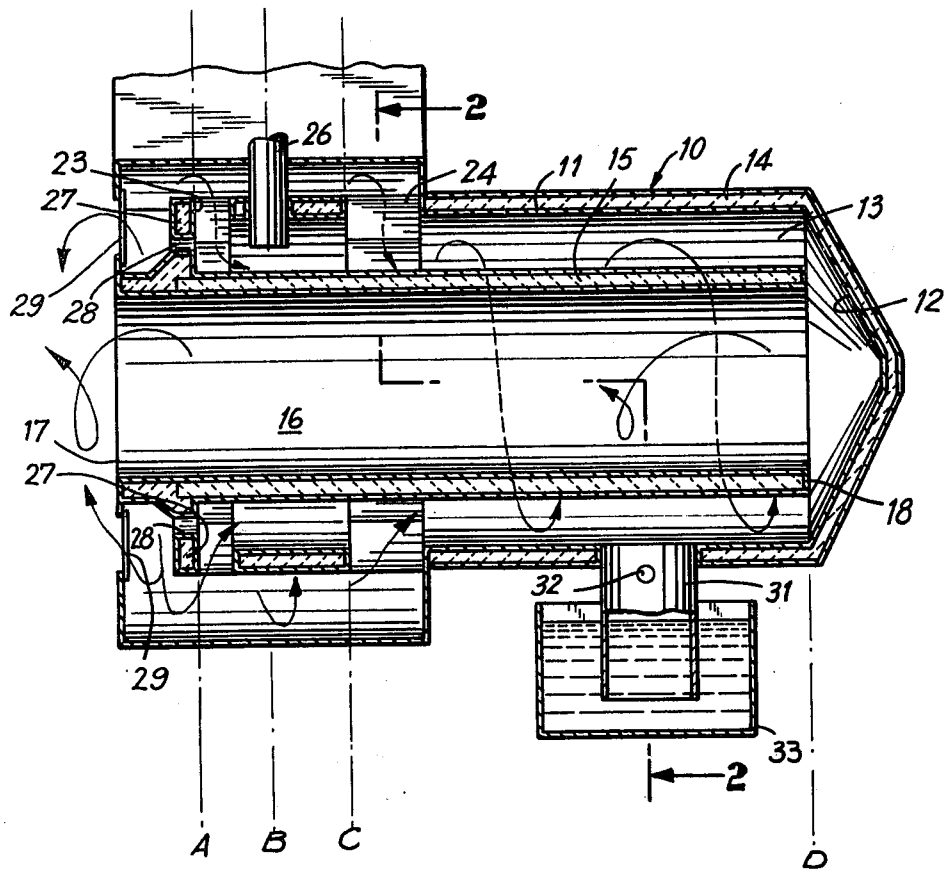
FIG. 1 is a longitudinal sectional view, in somewhat schematic form, of a preferred embodiment of the instant invention taken along line 1—1 of FIG. 2.

Referring now to the drawing, the burner is generally indicated at 10. A cylindrical inner wall 11 terminates at one end in a cone shaped portion 12 to define the outer chamber 13. The walls 11 and 12 are lined with highly insulated refractory material 14 to limit the escape of heat and aid in maintaining combustion temperatures within outer chamber 13. A cylinder 15 is located within inner wall 11 concentrically thereof and is spaced therefrom whereby the annulus between inner wall 11 and cylinder 15 define the outer chamber previously indicated at 13. Cylinder 15 is formed of a material which will withstand the high temperatures developed within the burner. The volume encompassed by cylinder 15 defines an inner chamber 16. The left end of cylinder 15 as shown in FIG. 1 defines the exit end 17 of the burner. The right end of cylinder 15 is indicated at 18 and defines the inner end of cylinder 15. The preferred location of inner end 18 is substantially at the plane defined by the intersection of inner wall 11 and cone shaped end 12.

An air box 21 surrounds burner 10 proximate the exit end to provide air for combustion. A blower (not shown) rams air into air box 21 through an air inlet 22. The velocity of inlet air at introduction to annulus 13 will be predetermined as a function of the character of the fuel to be burned. Also, the points of introduction of inlet air are dictated by the combustion characteristics of the fuel. Two air inlet locations are shown for outer chamber 13. A primary air inlet is indicated at 23 and a secondary air inlet is indicated at 24. Both air inlets may be in the form of tangential vanes 25 so that air is tangentially supplied to outer chamber 13. Tangential vanes 25 surround inner wall 11 to provide 360° of air inlet capability for both the primary air and the secondary air. It has been found that the secondary air inlet 24 is unnecessary on some instances such as for the combustion of rapidly igniting fuels including gas, oil and high volitile finely pulverized coal.

Means may be provided for adjusting the openings of primary air inlet 23 and secondary air inlet 24, such as by adjustment of vanes 25. As any suitable means for air inlet adjustment may be utilized and such means are known to those skilled in the art, it has been deemed unnecessary to show any particular embodiment of the air inlet adjustment means.

Located intermediate primary air inlet 23 and secondary air inlet 24 is a primary fuel inlet 26 which is shown schematically in the drawing as a pipe. The particular form of primary fuel inlet will depend on the type and nature of the fuel. It will be understood that the fuel could be gaseous, liquid with varying degrees of viscosity, or solid with a wide range of particle size and feed characteristics.

Burner 10 has a wall 27 which defines the end of outer chamber 13. Wall 27 engages inner wall 11 and cylinder 15 to close off the end of outer chamber 13. One or a plurality of auxiliary fuel inlets 28 may be provided for delivering auxiliary fuel into outer chamber 13. As shown in the drawing, the auxiliary fuel inlets may be in the form of ports spaced in a circle through end wall 27. This arrangement would be appropriate for a gaseous auxiliary fuel which could be introduced through air box 21. Other types of auxiliary fuel inlets could be provided depending on the nature of the auxiliary fuel. It has been found that the radiant energy levels of the burner are such that, once combustion has been initiated, sufficient energy may be present within the flame front to effect the ignition of the entering fuel particles and negate the requirement for a combustion sustaining auxiliary fuel. With some types of primary fuel, secondary fuel may be altogether unnecessary, even at start-up.

Air box 21 is depicted as being provided with a plurality of dampers 29 adjacent exit end 17. Dampers 29 would be adjustable by any suitable means (not shown) to permit a selected quantity of air from air box 21 to mix with the hot gases exiting from inner chamber 16 in order to and in the event that it is deemed necessary and desirable to cool the hot combustion gases.

Figure 2:
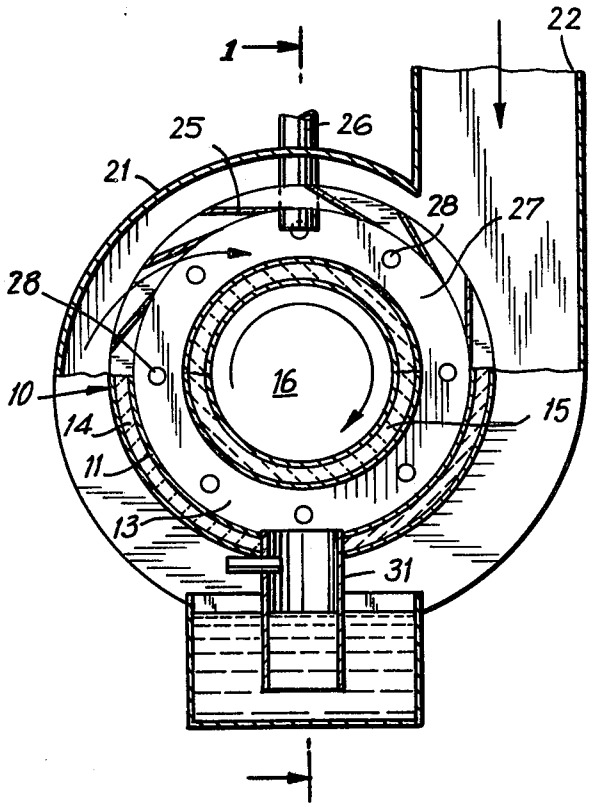
FIG. 2 is a sectional view taken along lines 2—2 of FIG. 1.

It should be noted that a plurality of arrows are shown in FIGS. 1 and 2 and these arrows represent the direction of flow of air and gases into, through and from burner 10 and air box 21.

Mounted on inner wall 11 in communication with outer chamber 13 is a slag tap 31 in order to tap off molten slag produced in the burner when it is operated at temperatures designed to create slagging conditions. A slag tap heater is indicated at 32 which would be useful during burner start up to prevent clogging of the slag tap. A container 33 is depicted for holding water to quench slag exiting from slag tap 31 to convert the slag from a molten to a solid state so that the slag can be removed.

A preferred embodiment of the burner of the instant invention has been described hereinabove. The preferred embodiment is suitable for burning solid fuels containing non-combustibles which will form slag and ash which will form unburned particulate. With other fuels certain component parts as described above may be unnecessary as will be hereafter more fully explained.

For purposes of illustration, the portions of outer chamber 13 have been divided into various zones. The area between lines A and B may be denominated the auxiliary fuel combustion zone. The area between lines B and C may be denominated the ignition zone and the area between lines C and D may be denominated the combustion zone. The area within inner chamber 16 would be the post combustion zone.

In any burner, the degree of efficiency is directly proportional to the quantity of fuel burned in relation to the quantity of fuel supplied. Theoretically with a long enough residence time and an adequate supply of oxygen, 100% of a fuel will be burned in a burner. As a practical matter, 100% efficiency is a goal which is never attained but always sought. In burning a fuel it is desirable to maintain the fuel in the air stream to provide maximum surface exposure for complete combustion. This is especially difficult in the burning of solid fuels which tend to settle out and collect on the walls of the burner. The present burner is especially suited for burning solid fuel with a high degree of efficiency because of its capability of maintaining the solid fuel entrained in the air stream for a sufficient period of time to allow substantially complete combustion to take place. A solid fuel introduced through primary fuel inlet 26 will become entrained in the spiral path of primary air introduced through primary air inlet 23. Ignition of the fuel will occur in the ignition zone and burning will occur throughout the combustion zone. Desirably, the fuel is completely burned by the time it reaches the end of the combustion zone at which point the gases are reversed to travel through the post combustion zone and out of exit end 17. In designing a burner such as burner 10, optimum sizing will depend on the fuel to be burned. Factors which must be considered are particle emissivity, the specific gravity of the primary fuel, the specific gravity of the ash in the fuel, the ignition time of the primary fuel, the lifting velocity of the particle, the fuel particle size and other elements which will determine how long it will take to ignite and burn the fuel, how far the fuel must travel before combustion is complete and the spiral air flow rate necessary to keep the particle being burned in suspension or entrained in the air so that it will have a maximum opportunity of burning to the fullest extent possible. Thus, an optimum burner would be sized for the fuel being burned and size would be a factor of the inside diameter of inner wall 11, the outside diameter of cylinder 15, the length of the ignition zone, the length of the combustion zone, the angle of input of the primary air inlet and the quantity of air being introduced through the primary air inlet. The capability of the fuel to generate sufficient heat to maintain combustion after start up would determine the need for auxiliary fuel and the secondary air requirements.

As aforenoted, efficient combustion requires maintaining the fuel in the combustion zone for an adequate period of time. In order to limit the effect of gravity on the residence time of the particle in the combustion zone, it is preferable to operate the burner in the horizontal mode as shown in FIG. 1 rather than in a vertical mode.

The foregoing burner is suitable for burning substantially all types of fuels. The output of the burner is hot combustion gases which exit at exit end 17 after having travelled through the post combustion zone. Temperatures within the ignition and combustion zones are developed and maintained by the heat of combustion, the particle emissivity and heat transfer through the thermally conductive cylinder 15. While the burner can effectively burn gaseous and liquid fuel, the burner is considered to be particularly suitable for the burning of solid fuel and especially those which are considered difficult to burn, such as waste materials, and those which have high ash content. Examples of "difficult" fuels are woodwastes with high moisture content, and processed and treated garbage.

The ability of the burner to efficiently burn "difficult" solid fuels and high ash content fuels is related to the design and construction heretofore described. Of particular importance is the ability to maintain the fuel entrained in the air stream as it travels through the combustion zone and the ability to extract particulate so that relatively clean combustion gases will exit from the burner. By operating the burner at sufficiently high temperatures, slag is formed and collects on the inner surface of cone shaped end 12 and inner wall 11 proximate the cone shaped end. The surface layer of slag also traps particulate which strikes the inner surface of the cone shaped end as the combustion gases reverse flow from outer chamber 13 to inner chamber 16. The slag with the trapped particulate is tapped off through slag tap 31 and, even with high ash fuels, tests have shown that relatively clean combustion gases exit the burner.

The burner configuration disclosed herein contributes to the effectiveness of combustion. The cylinder dividing the inner and outer chambers aids in maintaining laminar flow through the burner. As release of energy is a function of turbulence, the low turbulence found in the burner causes energy to be transferred directly to the particles thereby aiding combustion. Furthermore, it has been found that the burner approaches the ideal of a well stirred reactor which allows it to be operated under conditions of low excess oxygen.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A burner comprising first horizontal means defining an inner chamber, second horizontal means defining an outer chamber surrounding said inner chamber, each of said chambers having an upstream end and a downstream end, said downstream end of said inner chamber including means defining an opening through which combustion gases exit from the burner, said downstream end of said outer chamber having a closed end wall, said upstream end of said inner chamber being spaced from said end wall, first fuel inlet means located proximate said upstream end of said outer chamber and first air inlet means located proximate said upstream end of said outer chamber.

2. A burner as claimed in claim 1 wherein said end wall has a configuration such that all points thereon do not lie in a single plane.

3. A burner as claimed in claim 2 wherein said end wall joins said downstream end of said outer chamber in a line defining a plane, said upstream end of said inner chamber terminating proximate said plane.

4. A burner as claimed in claim 3 wherein said upstream end of said inner chamber lies in said plane.

5. A burner as claimed in claim 2 wherein said end wall has the general cross sectional configuration of a truncated cone.

6. A burner as claimed in claim 1 wherein said first means defining an inner chamber is in the form of a cylinder.

7. A burner as claimed in claim 6 wherein said second means defining an outer chamber is in the form of a cylinder.

8. A burner as claimed in claim 1 and further including primary air inlet means communicating with said outer chamber through said second means proximate said upstream end of said outer chamber.

9. A burner as claimed in claim 8 and further including primary fuel inlet means communicating with said outer chamber through said second means proximate said upstream end of said outer chamber.

10. A burner as claimed in claim 9 wherein said primary fuel inlet means is located downstream of said primary air inlet means.

11. A burner as claimed in claim 10 and further including secondary air inlet means communicating with said outer chamber through said second means, said secondary air inlet means being located downstream of said primary fuel inlet means.

12. A burner as claimed in claim 10 and further including secondary fuel inlet means communicating with said outer chamber upstream of said primary fuel inlet means.

13. A burner as claimed in claim 9 and further including air supply means proximate said upstream end of said outer chamber for supplying air to said primary air inlet means, said air supply means also including means for selectively supplying air to mix with the combustion gases exiting from the burner.

14. A burner comprising first horizontal generally cylindrical means defining an inner chamber, second generally horizontal cylindrical means defining an outer chamber surrounding said inner chamber and being spaced therefrom, each of said chambers having an upstream end and a downstream end, a closed end wall closing the downstream end of said outer chamber and being spaced from the upstream end of said inner chamber, means for introducing fuel into said outer chamber proximate the upstream end thereof, and means for introducing air under pressure in a spiral path of flow into said outer chamber at the upstream end thereof, said fuel being adapted to be entrained in said air travelling along a spiral path in said outer chamber, said air having the direction of flow thereof reversed upon striking said end wall and thereafter travelling through said inner chamber.

15. A burner as claimed in claim 14 wherein said end wall has a configuration of an outwardly extending truncated cone.

16. A burner as claimed in claim 15 wherein said end wall joins said downstream end of said outer chamber in a line defining a plane, said upstream end of said inner chamber terminating in said plane.

17. A burner as claimed in claim 16 and further including slag removal means formed on the bottom portion of said second cylindrical means.

* * * * *

UNITED STATES PATENT OFFICE

CERTIFICATE OF CORRECTION

PATENT NO. : 4,144,019

DATED : March 13, 1979

INVENTOR(S) : Norman A. Lyshkow, Herbert E. Beningson, Camillo V. Di Ruocco

It is certified that error appears in the above-identified patent and that said Letters Patent are hereby corrected as shown below:

Column 6, claim 8, line 1, delete "and further including" and insert - - wherein said first air inlet means comprises - -; and Claim 9, line 1, delete "and further including" and insert - - wherein said first fuel inlet means comprises - -.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*